US006212855B1

(12) United States Patent
Yasunaga et al.

(10) Patent No.: US 6,212,855 B1
(45) Date of Patent: Apr. 10, 2001

(54) DRUG BAG STRIP WINDING AND BUNDLING MACHINE

(75) Inventors: Itsuo Yasunaga; Hiroyasu Hamada, both of Osaka (JP)

(73) Assignee: Kabushiki Kaisha Yuyama Seisakusho, Osaka (JP)

( * ) Notice: Subject to any disclaimer, the term of this patent is extended or adjusted under 35 U.S.C. 154(b) by 0 days.

(21) Appl. No.: 09/290,240

(22) Filed: Apr. 13, 1999

(51) Int. Cl.[7] ..... B65B 63/04
(52) U.S. Cl. ..... 53/119; 53/591
(58) Field of Search ..... 53/118, 119, 116, 53/591

(56) References Cited

U.S. PATENT DOCUMENTS 4,601,154 * 7/1986 Ausnit ..... 53/119
4,694,959 * 9/1987 Ausnit et al. ..... 53/118
4,783,948 * 11/1988 Kando ..... 53/119

* cited by examiner

*Primary Examiner*—Peter Vo
*Assistant Examiner*—Louis Huynh
(74) *Attorney, Agent, or Firm*—Wenderoth, Lind & Ponack, L.L.P.

(57) ABSTRACT

A bundling device which can wind and bundle a web of drug bags in such a way that patients can take their drugs in the right order with high reliability. The bundling device includes a winder unit having a rotary table provided along a feed path of a web of drug bags, a pair of protrusions provided on the rotary table near its circumference for hooking the tip of the web, and another pair of protrusions provided on the rotary table near its circumference, diametrically opposite the former protrusions, for winding the web as the rotary table rotates. When the rotary table rotates with the web engaged by the first pair of protrusions, the web is wound around the two pairs of protrusions.

11 Claims, 6 Drawing Sheets

PRIOR ART

DRUG BAG STRIP WINDING AND BUNDLING MACHINE

BACKGROUND OF THE INVENTION

This invention relates to a winding machine for winding a strip of series-connected drug bags formed by a drug packaging machine, and a bundling machine for bundling the thus wound strip.

In a conventional bundling machine of this type, a web of serially connected drug bags formed by a drug packaging machine is automatically cut into a plurality of strips each for a particular patient and distributed to the respective patients.

As shown in FIG. 11, this conventional bundling machine comprises a cutter 2 for cutting a web of series-connected drug bags formed by a drug packaging machine W into a plurality of strips S each consisting of three bags F containing drugs to be taken in the morning, afternoon, and evening of one day, U-shaped gutters 18 for stacking the strips for each patient, and a bundling unit 6 for putting a band B around the stack of strips S in each gutter.

As shown in FIG. 11, the gutters 18 are movable laterally one by one to the position opposite an opening 16 of the bundling unit 6. With a gutter 18 opposite the opening 16, the stack of strips S in the gutter is pushed out into the opening 16 of the bundling unit 6 where a band B is put on, and the thus bundled strips are dropped into a box 19.

Since strips of drug bags are bundled for each patient, it is easy for hospital personnel to distribute each bundle of strips to the corresponding patient. Since each strip includes three bags containing drugs to be taken in the morning, afternoon and evening of each day, patients can take their drugs easily simply by opening the bags one at a time.

But since each bundle consists of a plurality of separate bags each for one day, a more or less senile patient might mistake drugs to be taken in the evening for drugs to be taken in the morning, or take only drugs to be taken in the morning.

Also, when the band is removed, strips tend to become scattered, so that handling is difficult even for sane patients.

An object of this invention is to provide a device which can wind a strip of serially connected drug bags in such a way that patients can take their drugs in the right order with high reliability, and a device for efficiently bundling the thus wound strip.

SUMMARY OF THE INVENTION

According to this invention, there is provided a winding machine for winding a web of serially connected drug bags which is being fed along a feed path, the winding machine comprising a pair of engaging members rotatably provided along the feed path for winding the web therearound with one end of the web engaged between the engaging members.

With the drug bag winding machine according to this invention, when the rotary member is rotated with the leading end of the web of drug bags engaged between one pair of the engaging protrusions, the web abuts another pair of protrusions and the first pair of protrusions repeatedly and alternately. The web is thus wound around two pairs of protrusions.

According to this invention, there is also provided a winding/bundling machine comprising a winding device for winding a web of serially connected drug bags which is being fed in a predetermined direction, a cutter for cutting the thus wound web into strips of a predetermined length, a conveyor for feeding the thus wound and cut strips of drug bags, and a bundling unit for putting a band around each of the wound, cut and fed strips of drug bags.

With the drug bag strip bundling machine according to this invention, while wound by the winding machine, the web is cut into strips each for one patient or one prescription. Each strip is fed by the conveyor and a band is put around the strip. The drug bags of each strip never separate from each other because they are integrally connected together.

In the arrangement in which the protrusions are retractable into the rotary member, strips can be more easily fed to the bundling station by removing them from the rotary member.

Other features and objects of the present invention will become apparent from the following description made with reference to the accompanying drawings, in which:

DETAILED DESCRIPTION OF THE PREFERRED EMBODIMENT

A winding device and a bundling device embodying this invention are described with reference to the accompanying drawings.

Figure 1:
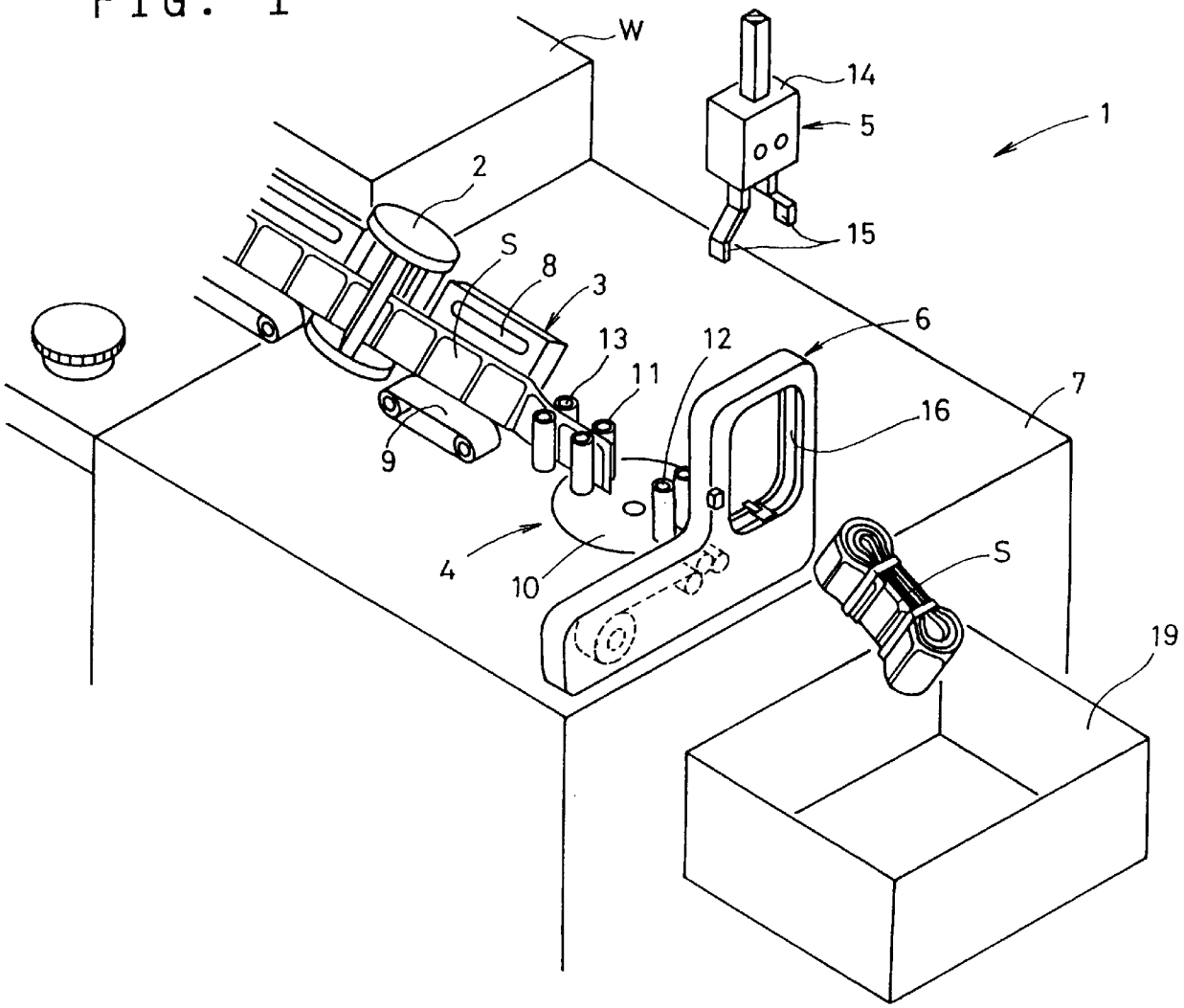
FIG. 1 is a perspective view showing a bundling machine embodying this invention.
Figure 2:
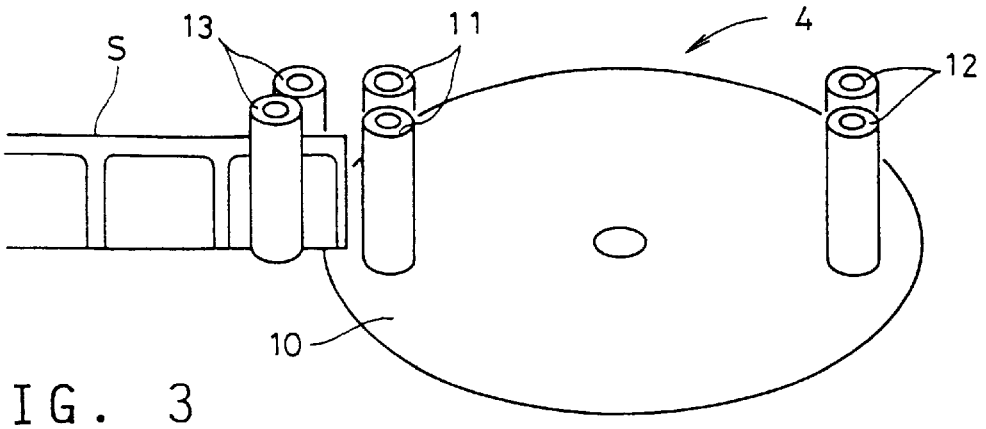
FIGS. 2 to 6 are perspective views showing how the strip is wound by the winding device of this invention.
Figure 3:
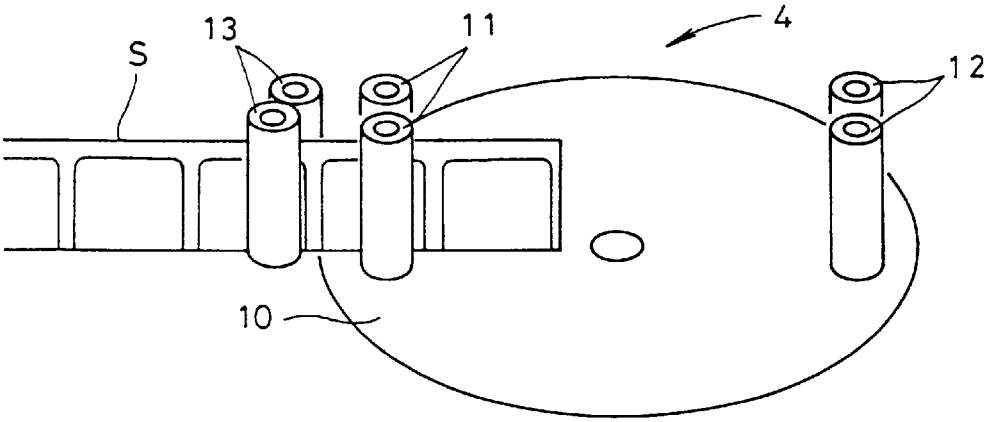
Figure 4:
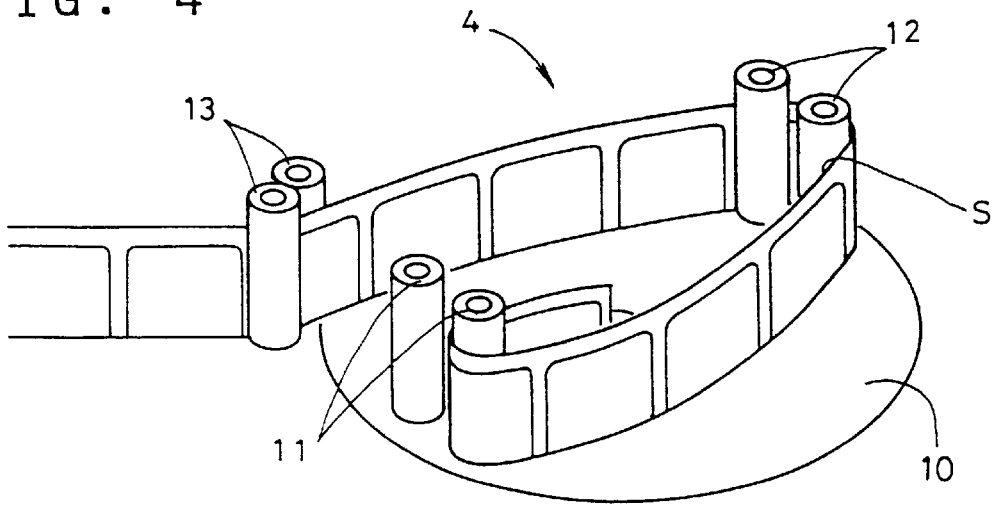
Figure 5:
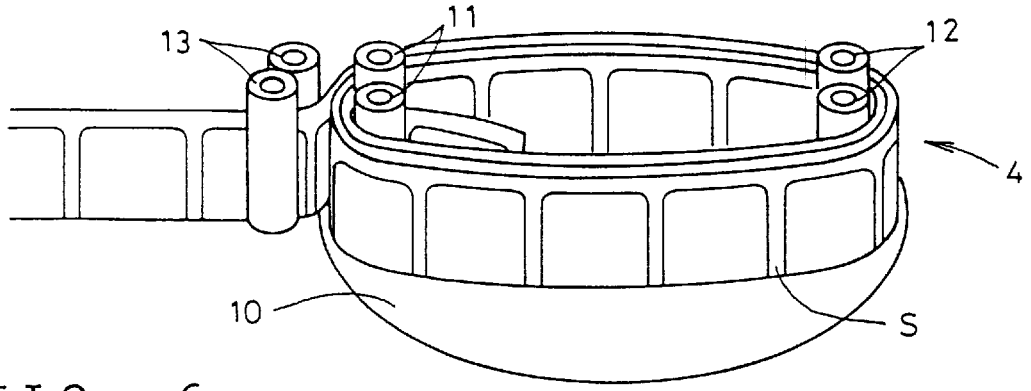

The bundling device 1 shown in FIG. 1 comprises a cutter 2 for cutting a web S of drug bags being fed in an inclined state into a plurality of strips, a feeder 3 for feeding the web fed from the cutter in an inclined state, a winder unit 4 for winding the web fed by the feeder 3, an arm 5 for gripping the strip wound by the winder unit 4 from both sides and feeding it in this state, and a bundling unit 6 for bundling the wound strip by putting bands B therearound. The device 1 is supported on a table 7.

Every time a portion of the web S for one patient has passed, the cutter 2 rotates to cut a strip for one patient.

The feeder 3 comprises a rail support 8 which receives the web from the cutter 2 in an inclined state, and a belt conveyor 9 for feeding the strip on the rail support 8.

The winder unit 4 comprises a disk-shaped rotary member 10 provided along the feed path of the web S and having its top surface flush with the top of the table 7. The rotary member 10 carries near its circumference a pair of vertical protrusions 11 and another pair of vertical protrusions 12 diametrically opposite and downstream of the protrusions 11 along the feed path.

FIGS. 2 to 5 show the operation of the winder unit 4. As shown, when the leading end of the web S inserted between a pair of guide protrusions 13 on the table 7 passes between the protrusions 11 on the rotary member 10 and protrudes therefrom a predetermined amount, the rotary member 10 is rotated by a drive means (not shown) provided inside the table 7 to catch the leading end of the web S on one of the protrusions 11. When the rotary member 10 further rotates from this state, the web S will get into contact with the other protrusions 12 and be wound around the protrusions 11 and 12.

Figure 6:
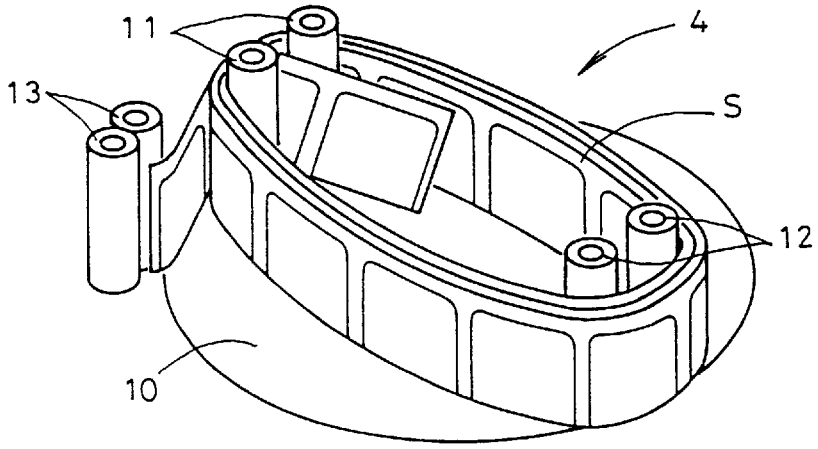

When the web S is wound by a predetermined length, it is cut by the cutter 2. A portion or strip of the web S is thus wound as shown in FIG. 6 to form an elongated coil.

Figure 7:
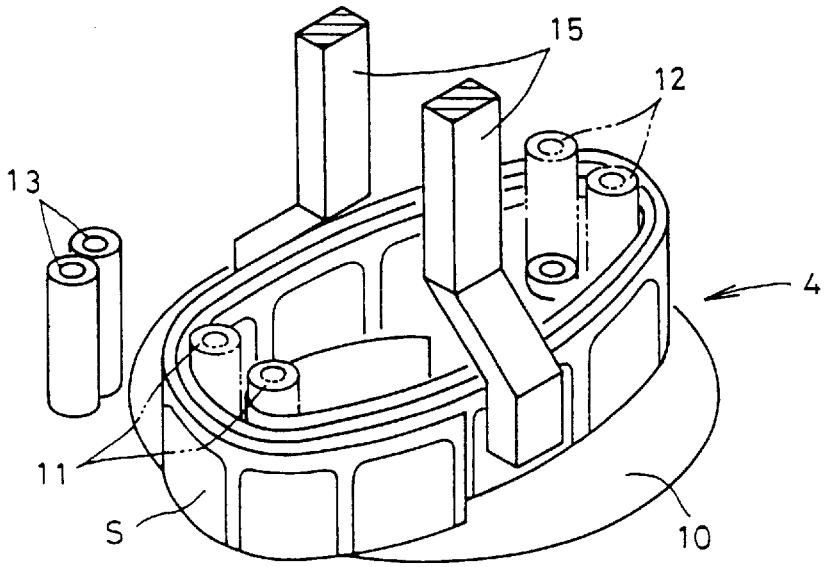
FIG. 7 is a perspective view showing the wound strip and a conveyor arm.

As shown in FIG. 1, the arm 5 includes a pair of fingers 15 moved toward and away from each other by a driving means in a driving box 14. With the arm 5 moved to a position over the rotary member 10 by an arm driving unit (not shown), the wound strip S is gripped by the fingers 15 from both sides as shown in FIG. 7. At this time, the protrusions 11 and 12 are retracted into the rotary member 10 so that wound strip S can be easily transported by the arm 5.

Figure 8:
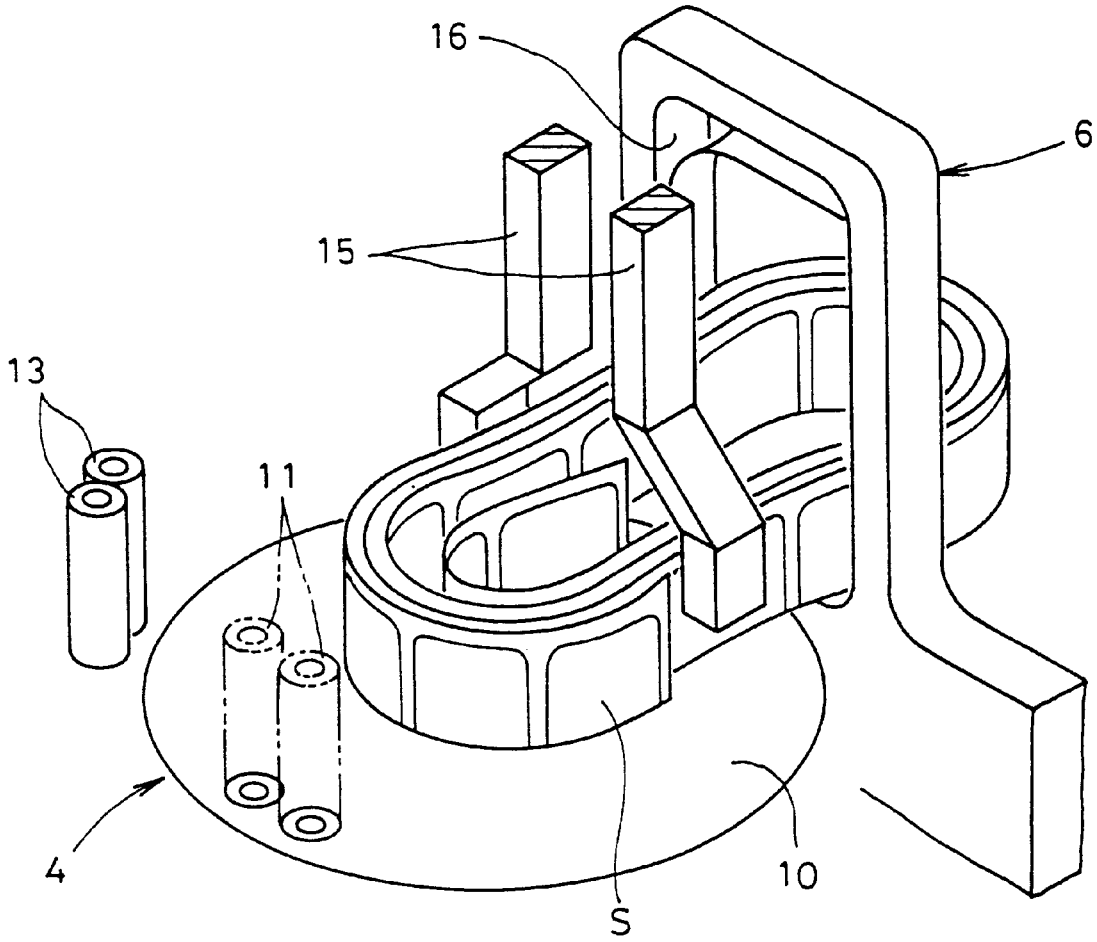
FIG. 8 is a perspective view showing a wound strip of drug bags being fed into a bundling device.
Figure 9:
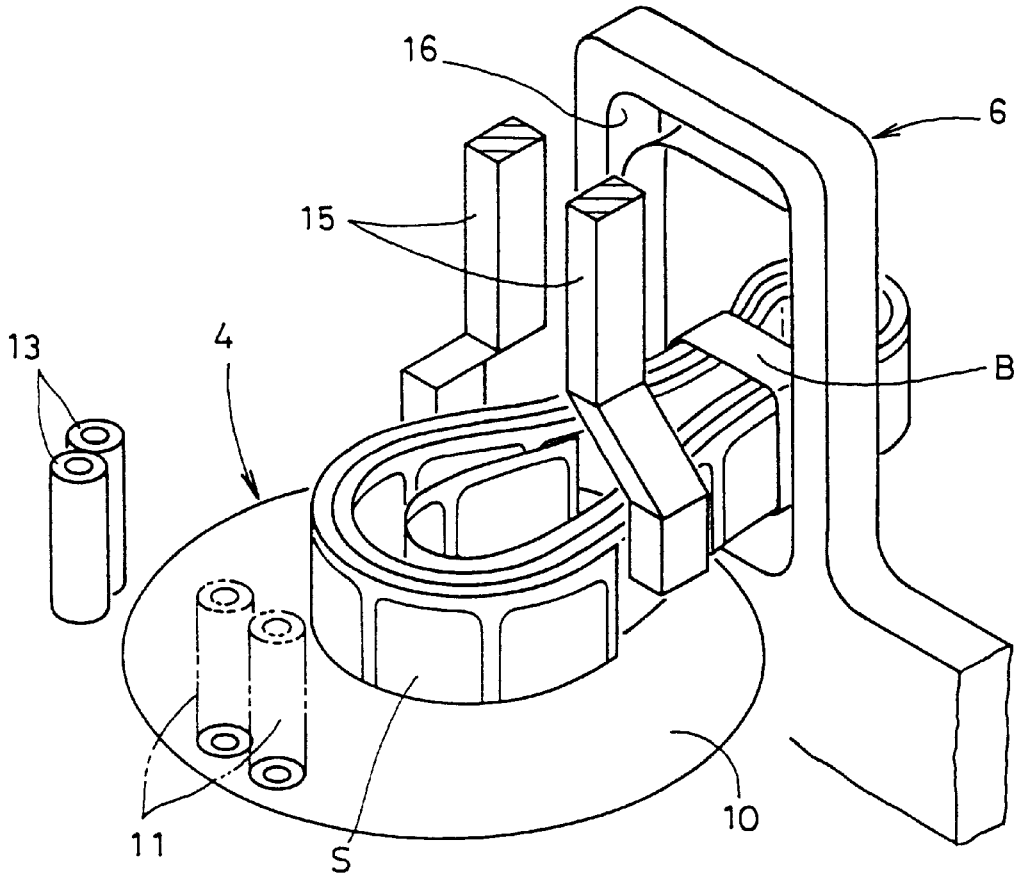
FIG. 9 is a perspective view of a wound strip being bundled.

The bundling unit 6 has an opening 16 (FIG. 8) through which the wound strip S can pass. With the strip S inserted in the opening 16, bands B are put therearound as shown in FIG. 9.

Figure 10:
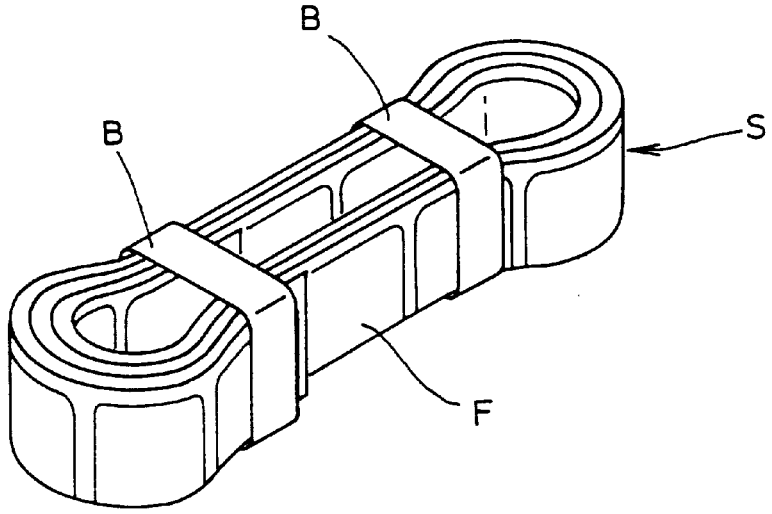
FIG. 10 is a perspective view of a bundled strip of drug bags.
Figure 11:
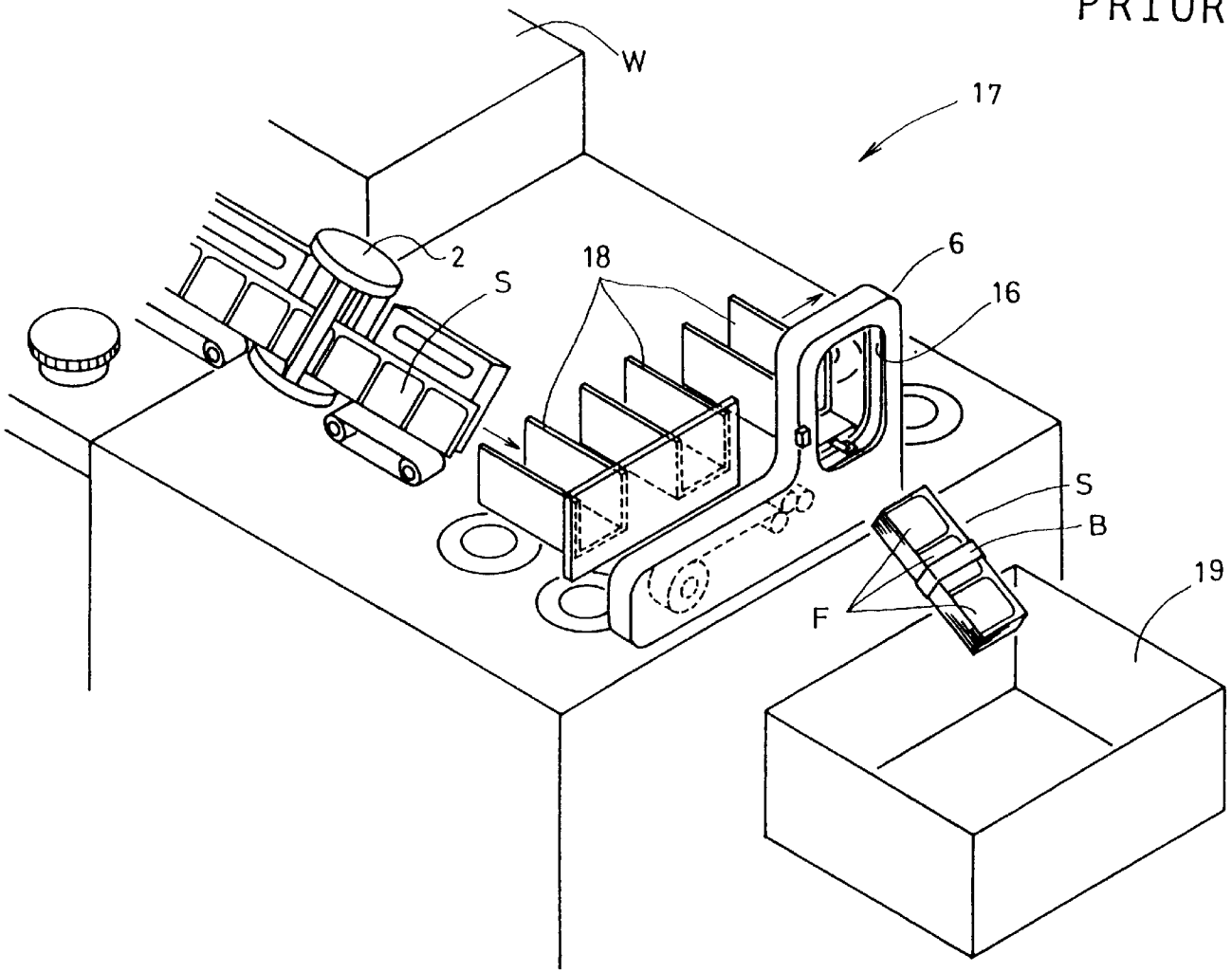
FIG. 11 is a perspective view of a conventional bundling machine.

As shown in FIG. 10, the bundling unit 6 puts two bands around the single strip S at two separate positions thereof.

The strip S thus wound by the winder unit 4 and bundled by the bundling unit 6 includes a plurality of drug bags arranged in the order in which the respective drugs therein are to be taken by a particular patient. Thus, by opening the bags F one at a time from the leading end of the strip, a patient cannot mistake the order in which the drugs are to be taken. Since the drug bags for each patient are connected together in the form of a single integral strip, they will never get scattered even when the bands B are removed. Handling is thus easy.

In the embodiment, the web S is fed in a laterally inclined state with the rotary member 10 rotated about a vertical axis. But instead, the web may be fed while being laid flat on the table with the rotary member 10 arranged to be rotatable about a horizontal axis.

Although in the preferred embodiment two pairs of protrusions are used as engaging members for catching and engaging one end of the web of drug bags, they may be replaced with any other type of engaging members, e.g. a pair of flat plates between which a leading end of the web of drug bags is inserted. But such engaging members have to be rotatably mounted to wind a web of drug bags around themselves.

Also, although in the embodiment a rotary table is used to carry two pairs of protrusions, it may be omitted if desired and circumstances permit.

The device of this invention enables patients to reliably take drugs in the right order. Since the drug bags for each patient are connected together as a single integral strip, they never become scattered when the bands are removed. Handling is thus easy.

What is claimed is:

1. A winding machine for winding a web of serially connected drug bags being fed along a feed path, said winding machine comprising:

a base;

a rotary member mounted to said base for rotation about a rotation axis;

a pair of first engaging members rotatably mounted on said rotary member, for rotation about said rotation axis, to engage a first end of the web therebetween; and a second engaging member rotatably mounted on said rotary member for rotation about said rotation axis, said second engaging member being disposed diametrically opposite said pair of first engaging members with respect to said rotation axis;

said first and second engaging members being arranged such that, with the first end of the web engaged between said pair of first engaging members and upon rotation of said first and second engaging members about said rotation axis, the web will be wound into an elongated coil trained about said first engaging members and said second engaging member such that a first end of the elongated coil engages said first engaging members and a second end of the elongated coil is disposed at said second engaging member.

2. A winding machine as claimed in claim 1, wherein said first engaging members are retractable away from the elongated coil formed upon completion of winding of the web about said first and second engaging members.

3. A winding machine as claimed in claim 1, wherein said second engaging member is retractable away from the elongated coil formed upon completion of winding of the web about said first and second engaging members.

4. A winding machine as claimed in claim 1, wherein said first and second engaging members are retractable away from the elongated coil formed upon completion winding of the web about said first and second engaging members.

5. A winding/bundling machine comprising:

a winding device for winding a web of serially connected drug bags being fed along a feed path;

a cutter for cutting the thus wound web into wound strips of a predetermined length; and a bundling unit for putting a band around each of the wound strips;

wherein said winding device comprises first and second engaging members mounted on a rotary member, said rotary member being rotatable about a rotation axis, said first and second engaging members being disposed at diametrically opposite positions with respect to said rotation axis about which said first and second engaging members are orbital;

said first and second engaging members being arranged such that, upon rotation of said first and second engaging members about said rotation axis, the web will be wound into an elongated coil trained about said first engaging member and said second engaging member such that a first end of the elongated coil engages said first engaging members and a second end of the elongated coil is disposed at said second engaging member.

6. A winding/bundling machine as claimed in claim 5, further comprising a conveyor for feeding the wound strips to said bundling unit.

7. A winding/bundling machine as claimed in claim 6, wherein said conveyor comprises a gripping unit for gripping the wound strips and feeding the wound strips to said bundling unit.

8. A winding device for winding a web of serially connected drug bags, said winding device comprising:

a rotary member provided along a feed path of the web of serially connected drug bags, said rotary member being rotatable about a rotation axis;

a pair of first protrusions provided on said rotary member near a periphery thereof to engage a leading end of the web therebetween; and a second protrusion provided on said rotary member near the periphery thereof and diametrically opposite said first protrusions with respect to said rotation axis;

said first and second protrusions being arranged such that, with the leading end of the web engaged between said pair of first protrusions and upon rotation of said rotary member about said rotation axis, the web will be wound into an elongated coil trained about said first protrusions and said second protrusion such that a first end of the elongated coil engages said first protrusions and a second end of the elongated coil is disposed at said second protrusion.

9. A winding device as claimed in claim 8, wherein said first and second protrusions are retractable into said rotary member.

10. A winding/bundling machine for winding and bundling a web of drug bags, said winding/bundling machine comprising:

a cutter provided along a feed path of the web for cutting the web into strips of a predetermined length;

a winding device for winding the strips, said winding device comprising a rotary member provided along the feed path of the web of drug bags, said rotary member being rotatable about a rotation axis, a pair of first protrusions provided on said rotary member near a periphery thereof to engage a leading end of the web therebetween, and a second protrusion provided on said rotary member near the periphery thereof and diametrically opposite said first protrusions with respect to said rotation axis, said first and second protrusions being arranged such that, with the leading end of the web engaged between said pair of first protrusions and upon rotation of said rotary member about said rotation axis, the web will be wound into an elongated coil trained about said first protrusions and said second protrusion such that a first end of the elongated coil engages said first protrusions and a second end of the elongated coil is disposed at said second protrusion; and a bundling unit provided along the feed path for putting a band around each of said elongated coils.

11. A winding device as claimed in claim 10, wherein said first and second protrusions are retractable into said rotary member.

* * * * *